US006484537B2

(12) United States Patent
Takessian

(10) Patent No.: US 6,484,537 B2
(45) Date of Patent: Nov. 26, 2002

(54) REPLACEABLE GEM STONE SETTING FOR A JEWELRY PIECE

(76) Inventor: Korabet Takessian, 41721 Hanford Rd., Canton, MI (US) 48187

( * ) Notice: Subject to any disclaimer, the term of this patent is extended or adjusted under 35 U.S.C. 154(b) by 0 days.

(21) Appl. No.: 09/769,001

(22) Filed: Jan. 24, 2001

(65) Prior Publication Data

US 2001/0032481 A1 Oct. 25, 2001

Related U.S. Application Data

(60) Provisional application No. 60/177,891, filed on Jan. 24, 2000.

(51) Int. Cl.[7] ..... A44C 17/02
(52) U.S. Cl. ..... 63/29.1; 63/26
(58) Field of Search ..... 63/26, 29.1

(56) References Cited

U.S. PATENT DOCUMENTS 766,435 A * 8/1904 Fitzgerald ..... 63/29.1
937,502 A * 10/1909 Allen ..... 63/29.1
1,182,534 A * 5/1916 Driggott ..... 63/29.1
1,712,171 A * 5/1929 Rochas ..... 63/29.1
1,726,926 A * 9/1929 Schwartz ..... 63/29.1
2,316,225 A * 4/1943 Hoffman et al. ..... 63/29.1
5,375,434 A * 12/1994 Wertheimer et al. ..... 63/29.1

* cited by examiner

*Primary Examiner*—J. J. Swann
*Assistant Examiner*—Andrea Chop
(74) *Attorney, Agent, or Firm*—John R. Benefiel

(57) ABSTRACT

A replaceable gem stone setting for a jewelry piece in which a casing receives a gem stone, and a bottom cover is hinged to the casing to be able to be moved to a closed position against the casing open bottom, the bottom cover having portions resiliently deflected by the gem stone as the cover is closed, resiliently holding the stone against abutments on the open top end of the casing through which the gem stone crown is displayed.

10 Claims, 2 Drawing Sheets

REPLACEABLE GEM STONE SETTING FOR A JEWELRY PIECE

CROSS REFERENCE TO RELATED PATENT APPLICATION

This application claims the benefit of provisional patent application Ser. No. 60/177,891, filed on Jan. 24, 2000.

BACKGROUND OF THE INVENTION

This invention concerns jewelry and more particularly settings which allow ready replacement of stones in the jewelry piece. Such capability has been found advantageous as allowing stones of different colors, types and cut, etc. to be placed in the jewelry piece, as to be better matched to a wearer's clothing, or simply to change the look of the jewelry piece from time to time.

Settings have thus heretofore been devised to allow this to be done. U.S. Pat. No. 5,375,434 shows a hinged cover which can be opened to release a stone which is held on a tapered seat fixed to the jewelry piece.

The hinging of the top cover reduces the aesthetic appeal of the piece, and the hand made hinge may not be accurate enough to insure engagement with the stone. Stones can vary in size considerably, as each stone is cut from a naturally occurring product.

U.S. Pat. No. 4,488,415 attempts to solve this by using a flexible hinged top to generate seating pressure against a flat based stone. The top hinge is still aesthetically unappealing. Spring element pedestals are also suggested, but these substantially increase the depth of the holder, creating a more bulky appearance.

Also, these springs are not compatible with a diamond cut stone.

U.S. Pat. No. 1,712,171 shows a bottom hinged holder, but relies on a positive engagement, problematic as mentioned above when considering the hand made nature of the hinge.

U.S. Pat. No. 5,992,177 shows a stone pressured by threading a cover down to force the stone against a resilient ring. This involves direct rubbing contact against the stone sides, and the necessity of machining threads into the cover and body components. There is a possibility of excessive pressure damaging the stone, as well.

Other such mountings involve separate loose springs or complicated parts.

It is the object of the present invention to provide a replaceable stone setting which applies only a light pressure on the stone, which is simple and reliable, does not involve separate loose parts, and does not increase the bulk of the jewelry piece nor otherwise degrade its aesthetic appeal of the piece.

SUMMARY OF THE INVENTION

The above recited object and other objects which will become apparent upon a reading of the following specification and claims are achieved by providing a stone setting including stone receiving bezel or case having an open top formed with an inwardly projecting lip rim extending inwardly around the opening (or a series of prongs), against which the crown or girdle of a gem stone may rest when inserted from the open bottom of the case. A bottom cover is hinged to the open bottom of the case and is formed with an array of radially convergent spring blades or fingers which are resiliently deflectable. The gem stone cullette and lower part of the gem stone pavilion is received in a central clearance between the inner tips of the blades when the cover is closed. The blades are cantilevered to be resiliently deflected when the cover is latched closed to generate a moderate pressure on the gem stone holding it securely in position against the inside of the rim or prongs at the top of the case.

The blades are preferably integrally formed with the cover.

A radial slot can also be formed in the cover to allow radial spreading of the blades to increase the degree of resilient deflection thereof able to be produced by the gem stone's engagement with the bottom cover.

A cover with a central opening supported by a deflectable arm can be used instead of the array of cantilevered blades.

A stone encircling wire ring can also be provided, pivoted to the inside of the case to prevent the stone from falling out if the cap unintentionally opens.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
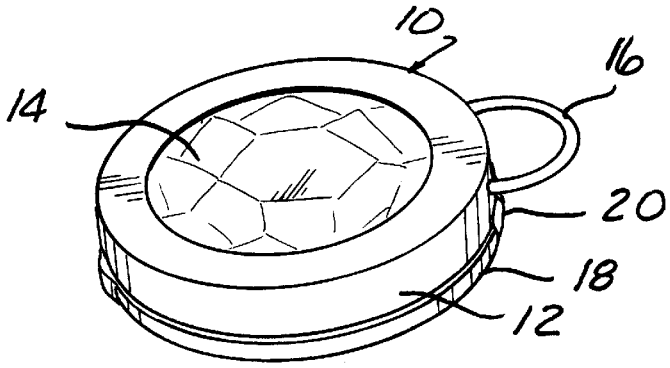
FIG. 1 is an enlarged perspective view of a piece according to the present invention.
Figure 2:
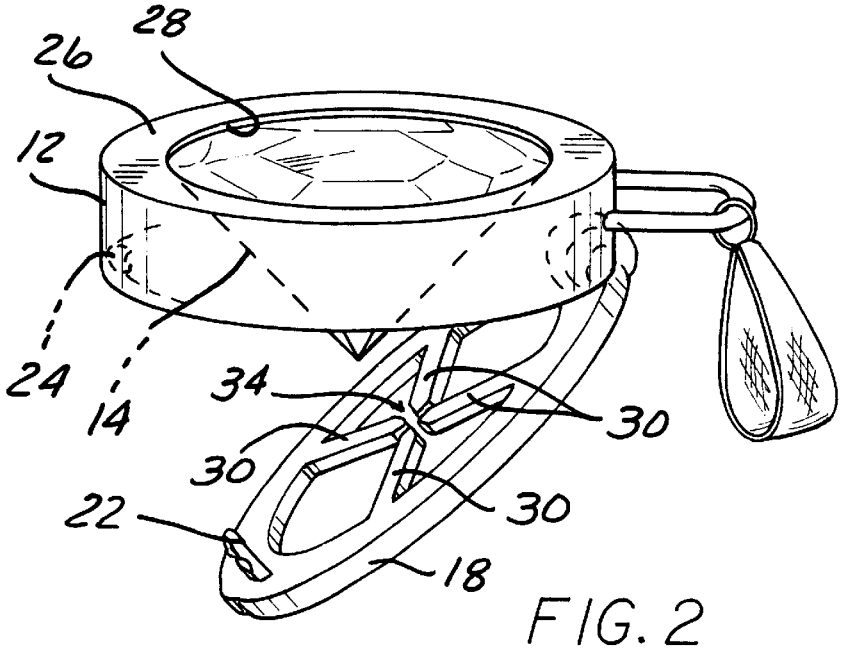
FIG. 2 is a perspective view of the jewelry piece with the bottom cover partially hinged open to show the construction thereof.
Figure 3:
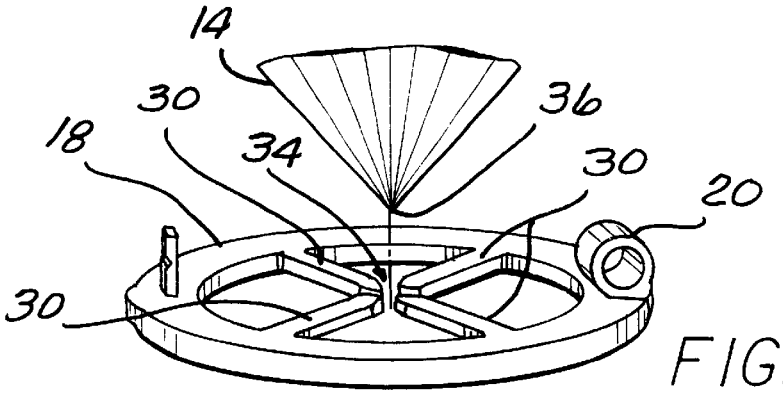
FIG. 3 is a perspective view of the cover and a juxtaposed diamond cut stone.

Referring to the drawings, the jewelry piece 10 is shown in FIGS. 1–3 as a pendant, including a casing or bezel 12 mounting a replaceable gem stone 14. A loop 16 is attached to the casing metal 12 for attachment of a chain (not shown). A bottom cover 18 is mounted to a hinge 20 enabling the bottom cover 18 to be opened. A latch hook 22 engages a catch 24 to hold the bottom cover 12 in a closed position overlying the open bottom of the casing 12.

The casing 12 has an inturned rim or lip 26 extending around an opening 28 at the top of the casing 12, through which protrudes the crown of the gem stone 14. The crown or girdle of the gem stone 14 is pressed against the inside of the rim 26 by a spring force generated by engagement of the gem stone 14 with the tips of a plurality (four shown) of radially convergent fingers or spring blades 30 integrally formed to project towards the center of an opening 32 in the bottom cover 18. Each of the blades 30 terminate short of the other blades 30 that a small intermediate space 34 is surrounded by the tips of the free ends of the blades 30.

The space 34 receives the cullette 36 of the gem stone 14 so that the lower most region of the pavilion or sides of the gem stone 14 are engaged with the tips of the blade 30 as the bottom cover 18 is closed. This causes the cantilevered blade 30 to resiliently deflect and generate an upward spring force urging the crown or girdle of the gem stone 14 against the rim 26 of the casing 12. The blades 30 by engaging the lower smaller end of the gem stone 14 laterally locate the gem stone 14 but can adapt to any size of stone by the resilient deflection of the blades 30. Also, the blades 30 can be bent to accommodate larger or shorter height stones.

Figure 4:
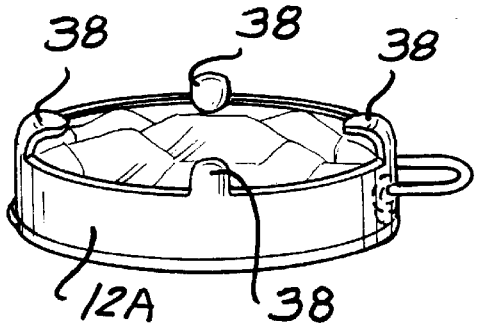
FIG. 4 is a perspective view of an alternate form of jewelry piece according to the invention.

FIG. 4 shows the use of prongs 38 on the casing 12A to provide a discontinuous stop portion instead of the continuous rim 26.

Figure 5:
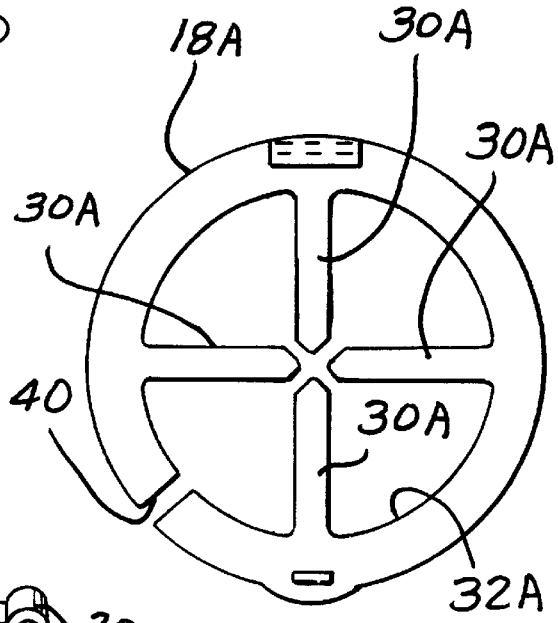
FIG. 5 is a plan view of an alternate form of the bottom cover used with the jewelry piece according to the invention.

FIG. 5 shows the addition of a radial slit 40 in the bottom cover 18A. This allows radial expansion to occur as the blades 30A are deflected axially to generate additional spring force.

Figure 6:
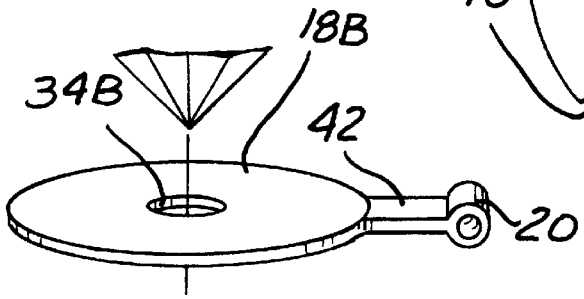
FIG. 6 is a perspective view of another alternate form of the bottom cover.

FIG. 6 shows a thin flexible metal cover 18B with only an opening 32B, spaced from the hinge 20B by a spring arm 42, bending to generate a spring force when engaging a gem stone.

Figure 7:
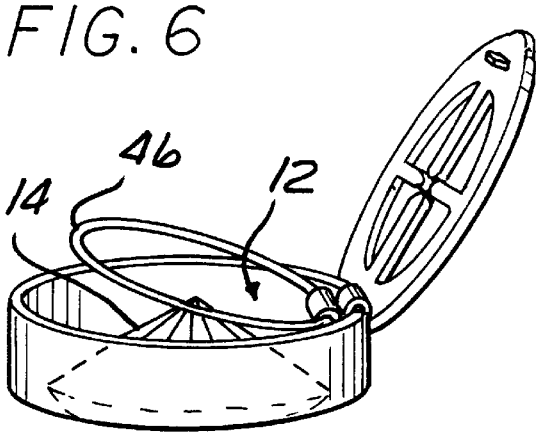
FIG. 7 is a perspective view of a jewelry piece according to the invention with an opened bottom cover showing an optional safety lock for the stone.

FIG. 7 shows the gem setting equipped with a safety lock loop 46 pivoted to the inside of a casing 12, gripping the pavilion of the gem stone 14. This holds the gem stone 14 in case the bottom cover 18 opens accidentally.

Figure 8:
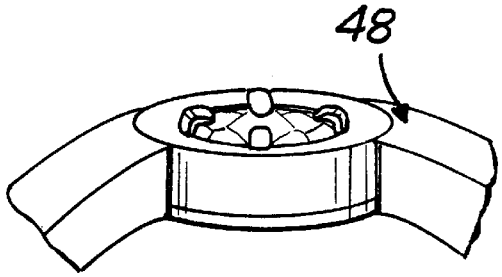
FIG. 8 is a fragmentary perspective view of a gem stone setting according to the invention used in a ring.

FIG. 8 shows the application of the setting of the invention to a ring 48 comprising the jewelry piece utilizing the gem stone setting according to the invention.

Figure 9:
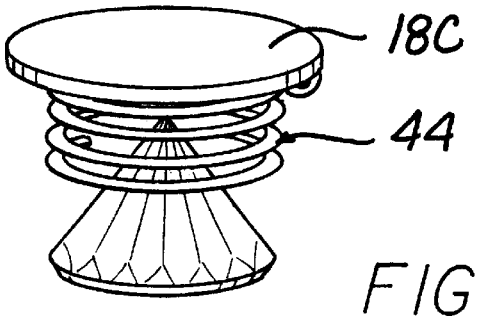
FIG. 9 is an exploded perspective view of certain parts of a setting using a separate spring to generate the spring force by the cover.

FIG. 9 shows a separate helical spring 44 interposed between the bottom cover 18C and the gem stone 14 to generate the spring force. An elastic pad could also be placed on the inside of the cover to be compressed against the lower end of the stone as the bottom cover is closed.

What is claimed is:

1. A jewelry piece having a gem stone and a replaceable gem stone setting, said gem stone setting comprising:

a casing defining a cavity for receiving said gem stone, said casing open at opposite ends, with an open top end having a portion abutting an upper portion of said gem stone when said gem stone is received in said casing so as to display a crown thereof in said open top end of said casing;

a bottom cover and a hinge connecting said bottom cover to an open bottom end of said casing to be movable to a closed position overlying said bottom end of said casing;

a latch for securing said bottom cover in said closed position; and said bottom cover having a plurality of radially extending convergent and cantilevered spring blades, connected at one end to said bottom cover and having a free end, said plurality of said spring blades surrounding and engaging said gem stone when said gemstone is received in said casing to confine said stone and urge the same against said casing top end portion, each spring blade resiliently deflected by engagement with said gem stone when said bottom cover is moved to said closed position, whereby said gem stone is resiliently held in abutment against said casing top end portion by a spring force generated by said deflection of said spring blades, said gem stone being located laterally with respect to said bottom cover by said engagement with said surrounding spring blades.

2. The jewelry piece according to claim 1 wherein said spring blades together form an opening for receiving a cullette and lower pavilion part of said gem stone.

3. The jewelry piece according to claim 2 wherein said free end of each of said radially extending spring blades are resiliently deflected in a direction away from said casing when said gem stone is positioned abutting said casing top end portion when said bottom cover is in said closed position.

4. The jewelry piece according to claim 3 wherein said radially extending spring blades are integrally formed with said bottom cover.

5. The jewelry piece according to claim 2 wherein said bottom cover includes an outer annular rim portion formed with said spring blades integral therewith and extending radially inwards therefrom.

6. The jewelry piece according to claim 5 wherein said annular rim portion is split to increase the deflectability of said spring blades.

7. The jewelry piece according to claim 1 wherein said casing has a rim lip forming a bezel at said top end.

8. The jewelry piece according to claim 1 wherein a plurality of bent over prongs are formed about said top end of said casing.

9. The jewelry piece according to claim 1 wherein an eye is fixed to said casing, said jewelry piece comprising a pendant.

10. The jewelry piece according to claim 1 wherein said jewelry piece is attached to a ring.

* * * * *